US005769064A

United States Patent [19]

Lu et al.

[11] Patent Number: 5,769,064

[45] Date of Patent: Jun. 23, 1998

[54] ELASTIC BAND POWERED BALL PROJECTING MACHINE

[76] Inventors: Jian Gang Lu; Xian Li Ni, both of 6436 Shoreline Dr., Troy, Mich. 48098

[21] Appl. No.: 438,047

[22] Filed: May 8, 1995

[51] Int. Cl.[6] ..... F41B 7/00

[52] U.S. Cl. ..... 124/21; 124/35.1; 273/26 D

[58] Field of Search ..... 124/17, 16, 6, 124/7, 18, 21, 26, 27, 35.1, 41.1, 83; 273/26 D

[56] References Cited

U.S. PATENT DOCUMENTS

| | | | |
|---|---|---|---|
| 1,194,093 | 8/1916 | Stroup | 273/26 D |
| 2,267,162 | 12/1941 | Moser | 124/17 |
| 2,267,163 | 12/1941 | Moser | 124/17 |
| 2,313,409 | 3/1943 | Walker | 124/17 |
| 2,540,303 | 2/1951 | La Clare Sylvester | 124/21 |
| 2,646,785 | 7/1953 | Goldman | 124/21 |
| 3,102,526 | 9/1963 | Connor | 124/83 X |
| 3,549,148 | 12/1970 | Schloss | 124/21 X |
| 3,774,585 | 11/1973 | Boyd | 124/21 |
| 4,165,729 | 8/1979 | Niemirow | 124/17 |
| 4,721,091 | 1/1988 | Ridley et al. | 124/7 X |
| 5,067,471 | 11/1991 | Kim | 124/17 X |
| 5,123,643 | 6/1992 | Heilhecker et al. | 124/81 X |
| 5,265,583 | 11/1993 | Otto | 124/46 X |

FOREIGN PATENT DOCUMENTS

| | | | |
|---|---|---|---|
| 1495308 | 9/1967 | France | 124/17 |
| 632976 | 6/1936 | Germany | 124/17 |

*Primary Examiner*—John A. Ricci
*Assistant Examiner*—Thomas A. Beach

[57] ABSTRACT

An elastic band powered ball projecting machine is capable of hurling baseball, softball, tennis ball and simulated ball for batting practice. The machine includes a tube assembly within which a carrier and a piston slide rearwardly between a neutral position and a loaded position and forwardly between the loaded position and a release position. An elastic band is disposed in the piston and the two ends of the elastic band are secured on a frame which is mounted on a supporting assembly. The piston is linked with a roller of a clutch and ratchet mechanism by a wire. The elastic band is stretched under the tension of its own elasticity between the neutral position and the loaded position by pedaling a clutch and ratchet mechanism. A ball placed in the carrier is propelled forwardly out of the tube assembly when a release handle pushes a clutch sleeve of the clutch and ratchet mechanism and the clutch sleeve disengage with the roller of the clutch and ratchet mechanism to release the stored energy in the tension bands.

12 Claims, 14 Drawing Sheets

ELASTIC BAND POWERED BALL PROJECTING MACHINE

BACKGROUND OF THE INVENTION

1) Field of the Invention

The present invention relates to an elastic band powered ball projecting machine in which the pitching angle and the pitching distance of the ball can be adjusted easily for hurling baseballs, tennis balls, softballs and simulated balls for the purpose of batting practice.

2) Description of the Prior Art

Many different types of ball throwing and or propelling machines for tennis ball, baseball and softball training are commonly powered by a motor which requires electric power supply. It has been a great disadvantage to use them outdoors, which has caused safety concerns because of the possibility of exposing to rain and other weather conditions. Also the machine have been installed at certain places where must have the access to electric power source. Therefore the users and the place of use have been limited.

Most of the machines are large, expensive and inconvenient for either moving or carrying.

SUMMARY OF THE INVENTION

It is a primary object of the present invention to provide a ball projecting machine which does not require electric power supply and avoid the machine is used outdoors.

It is another object of the present invention to provide a ball projecting machine which can propel different balls, such as tennis balls, softballs, baseballs and simulated balls for the players of family and small league to practice the batting techniques.

It is a further object of the present invention to provide a ball projecting machine which can vary the speed and pitching angle of the balls for the further improvement of the batting techniques.

It is a further object of the present invention to provide a ball projecting machine which is inexpensive by using easily replaceable elastic bands for propelling the balls.

Other objects and advantages of the present invention will become apparent from the following description of preferred embodiments and the drawings of the invention.

DESCRIPTION OF THE PREFERRED EMBODIMENT

Figure 1:
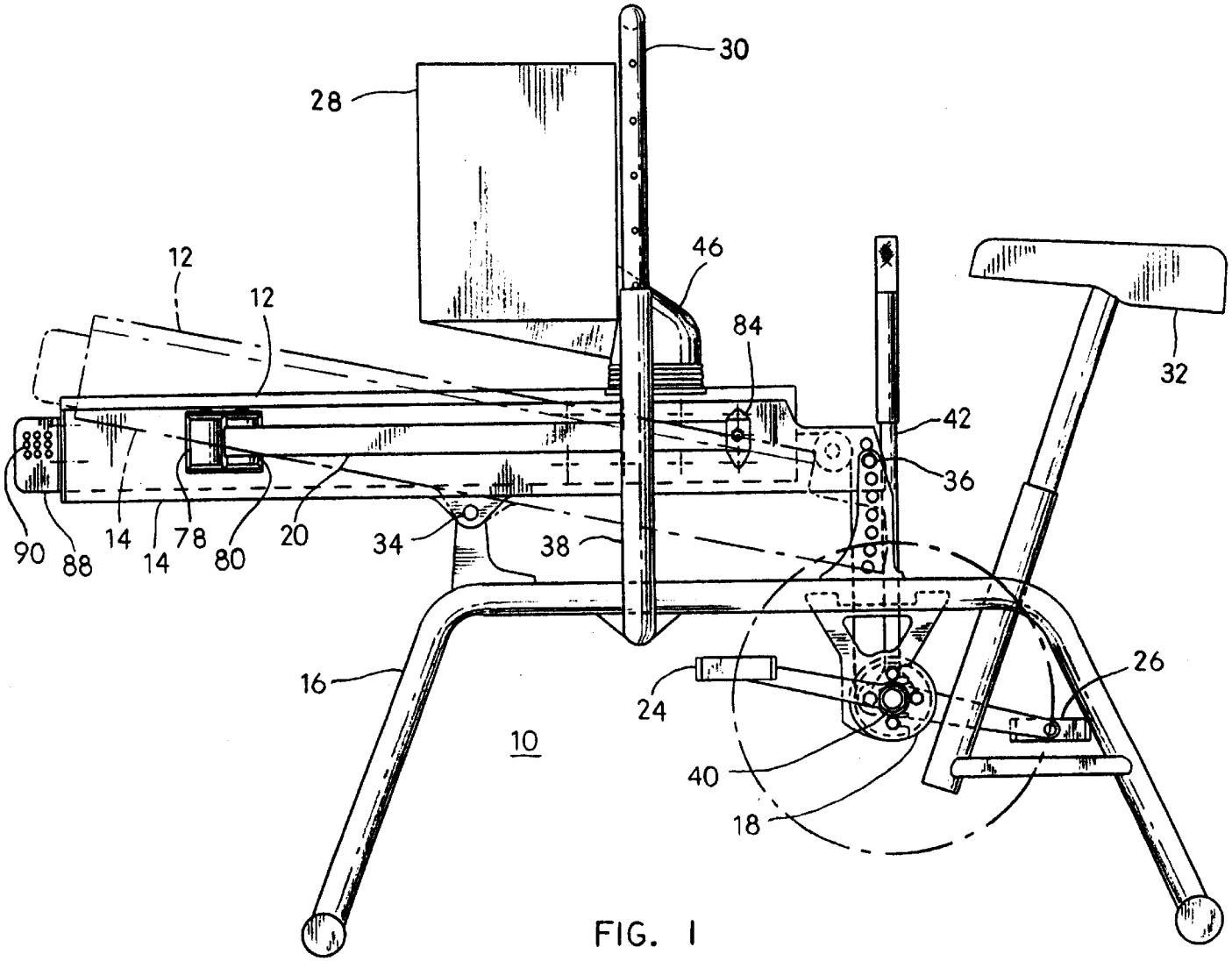
FIG. 1 is a side view of our invention showing the entirety of the ball projecting machine with an adjustable pitching angle position.
Figure 2:
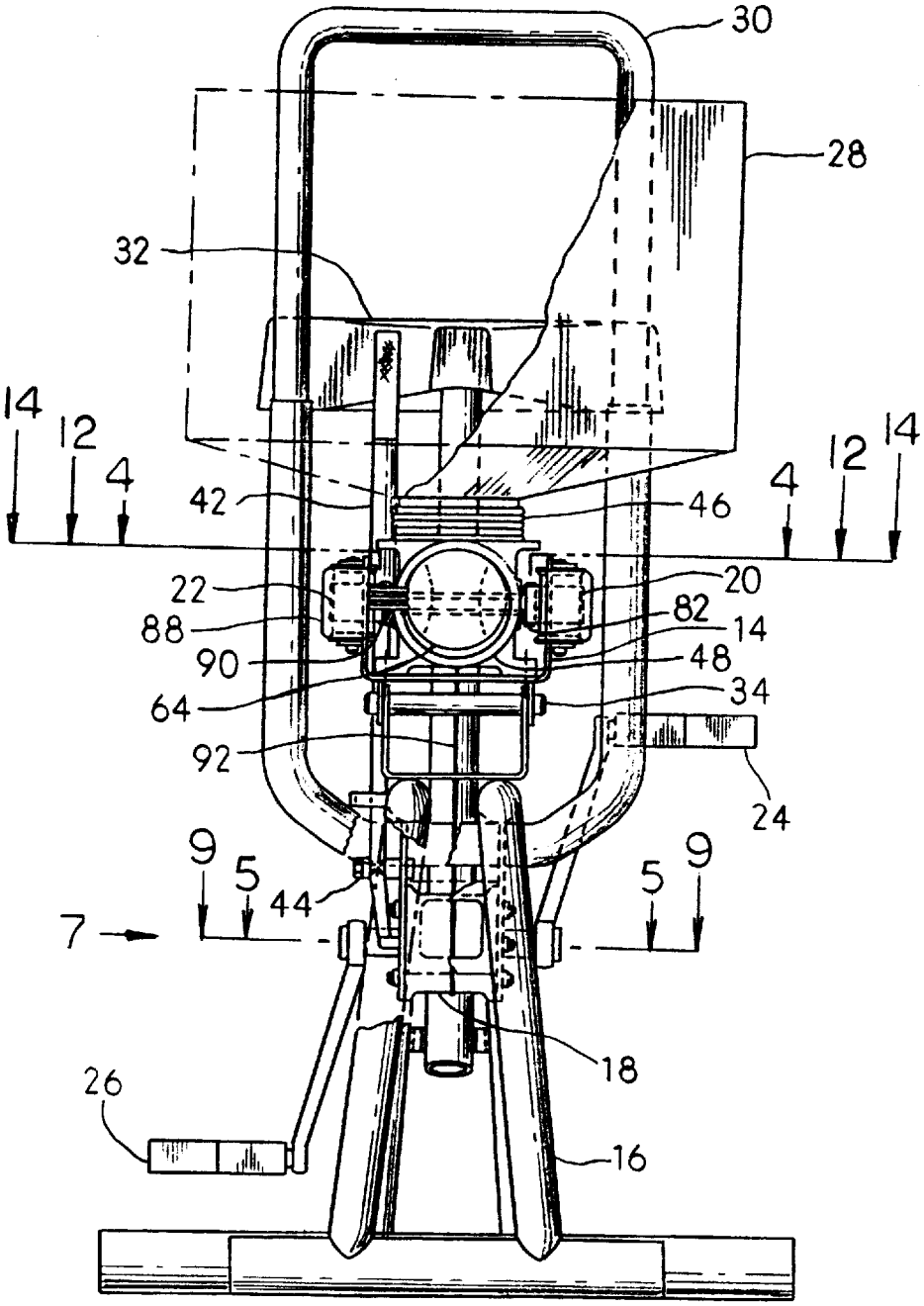
FIG. 2 is a front view of our invention with a partial cut away of the ball basket and the support assembly.
Figure 3:
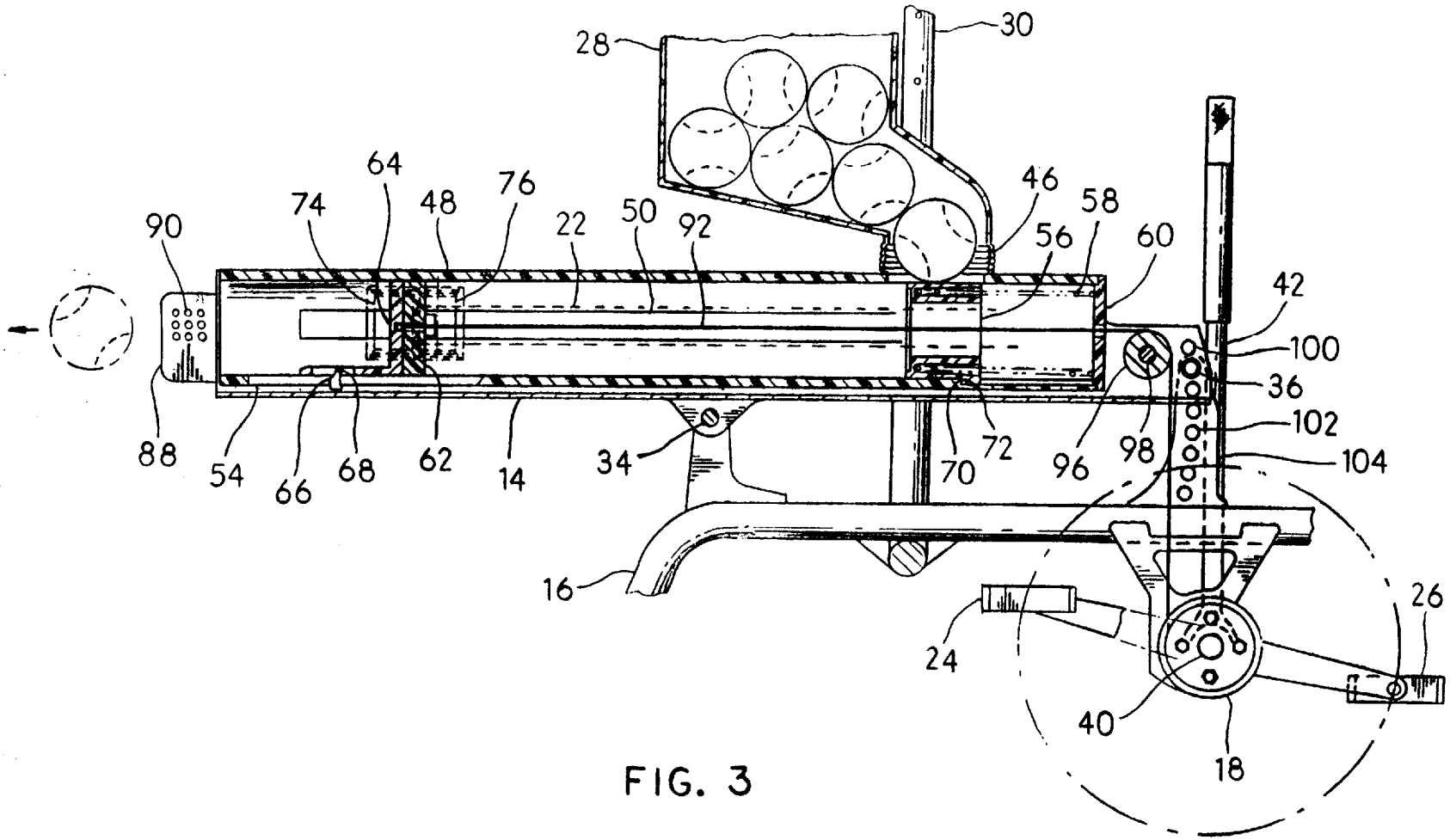
FIG. 3 is a side elevation view with a cut away along the tube assembly showing the projecting machine in neutral position.

FIG. 1 shows the invention as a projecting machine 10 which comprises a tubular assembly 12, a frame 14, a support assembly 16 and a clutch and ratchet mechanism 18, a pair of elastic bands 20 and 22, a pair of pedals 24 and 26, a ball basket 28, an adjustable handle 30 and a seat 32. As shown in FIGS. 1, 2 and 3, the adjustable seat 32 is mounted on the support assembly 16. The tubular assembly 12 is fixedly fastened on the frame 14 and the frame 14 is secured on the support assembly 16 by a pivot pin 34 and a locking pin 36. A handle support 38 with an adjustable handle 30 is fixedly secured on the support assembly 16. The ball basket 28 is mounted on the handle support 38. The pedals 24 and 26 are disposed on two ends of the shaft 40 respectively which drives the clutch and ratchet mechanism 18.

In FIG. 2, a clutch release handle 42 is mounted on the support assembly 16 with a pivot point 44. The ball basket 28 with an extended flexible tube 46 is disposed on the handle support 38 and the flexible tube 46 is attached onto the opening of the tubular assembly 12.

Figure 4:
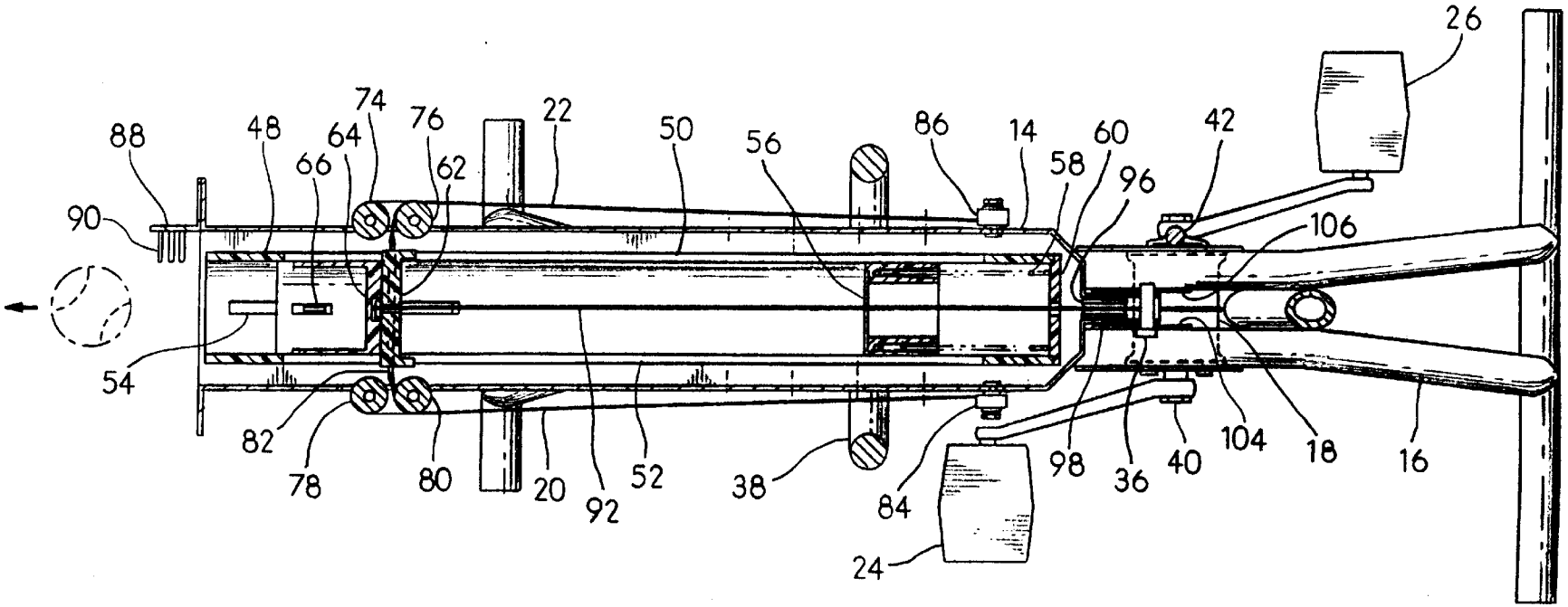
FIG. 4 is a cross sectional top view taken along line 4—4 of FIG. 2 showing the projecting machine in neutral position.

In FIGS. 3 and 4, the tubular assembly 12 includes a tubular body 48 with two slots 50 and 52 on the sides and one slot 54 on the bottom, a plunger 56, a spring 58, a cap 60, a piston 62 and a carrier 64 with a retaining tab 66 secured on the carrier 64 by a pin 68. The carrier 64 is secured on the piston 62 by means well know and both the carrier 64 and the piston 62 are slidable reciprocally in the tubular body 48. The slots 50 and 52 of the tubular body 48 guide the piston 62 for moving reciprocally within said tubular body 48 between a release position and a loaded position. The carrier 64 and the piston 62 can be easily assembled and disassembled when both the carrier 64 and the piston 62 are pulled out of the tubular body 48 forwardly. The carrier 64 can be made in different sizes with same outer diameter which fits in the tubular body 68 freely for carrying the different size balls for the different ball practices.

As shown in FIGS. 3, 4, 11, 12, 13 and 14, the plunger 56 is disposed in the rear potion of the tubular body 48. The cap 60 is secured in the rear end of the tubular body 48. The spring 58 is compressed between the plunger 56 and the cap 60. The spring 58 pushes the plunger 56 to the ball dropping position which is determined by a step 70 of the tubular body 48 and a step 72 of the plunger 56, and keeps the ball from dropping down into the tubular assembly 12 when the projecting machine is in a neutral and the release positions.

As shown in FIGS. 2, 3 and 4, a pair of equally lengthen elastic bands 20 and 22 are guided by two pairs of rollers 74, 76 and 78, 80 respectively which are mounted on each side of the frame 14 at the front end. A short cable 82 is attached across the piston 62 and links both elastic band 20 and 22. The other end of elastic band 20 is secured on a clamp 84 and attached to one side of the frame 14 at the rear end, and also the other end of elastic band 22 is secured in a same manner as the elastic band 20 on a clamp 86 and attached to the other side of the frame 14. A bracket 88 with a friction pad 90 can be attached to either side of the frame 14 at the front end by means well know.

The friction pad 90 contacts the side of a ball when the ball is projected forwardly out of the tubular body 48, and it causes the ball moving forwardly in a curved orbit.

A cable 92 links the piston 62 and the roller 94 of the clutch and ratchet mechanism 18 by routing through a guiding roller 96. The guiding roller 96 is secured on the frame 14 by a pin 98.

Further more shown in FIGS. 2,3 and 4, a series of holes 100 at the rear end of the frame 14 has equal space as a series of holes 102 on supporting plates 104 and 106. The supporting plates 104 and 106 are fixedly secured on the support assembly 16 by means well know. The tubular assembly 12 fixedly fastened on the frame 14 can be rotated around the pivot pin 34 when the locking pin 36 is removed out of the locking position. The locking pin 36 is secured in one of holes 100 and one of the holes 102 when the appropriate holes are selected and aligned for the desired pitching angle.

Figure 5:
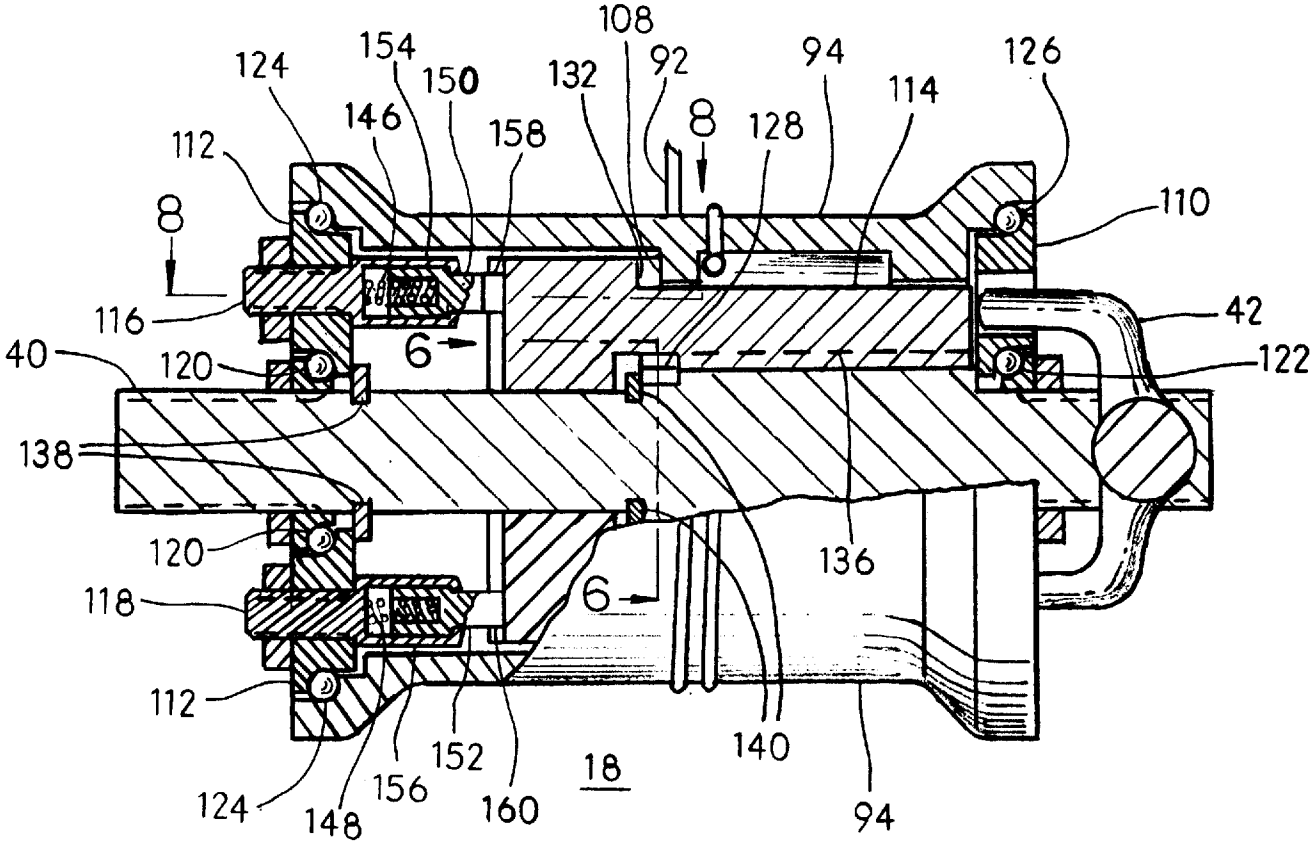
FIG. 5 is a cross sectional view taken along line 5—5 of FIG. 2 showing the clutch and ratchet mechanism in engaged position.
Figure 6:
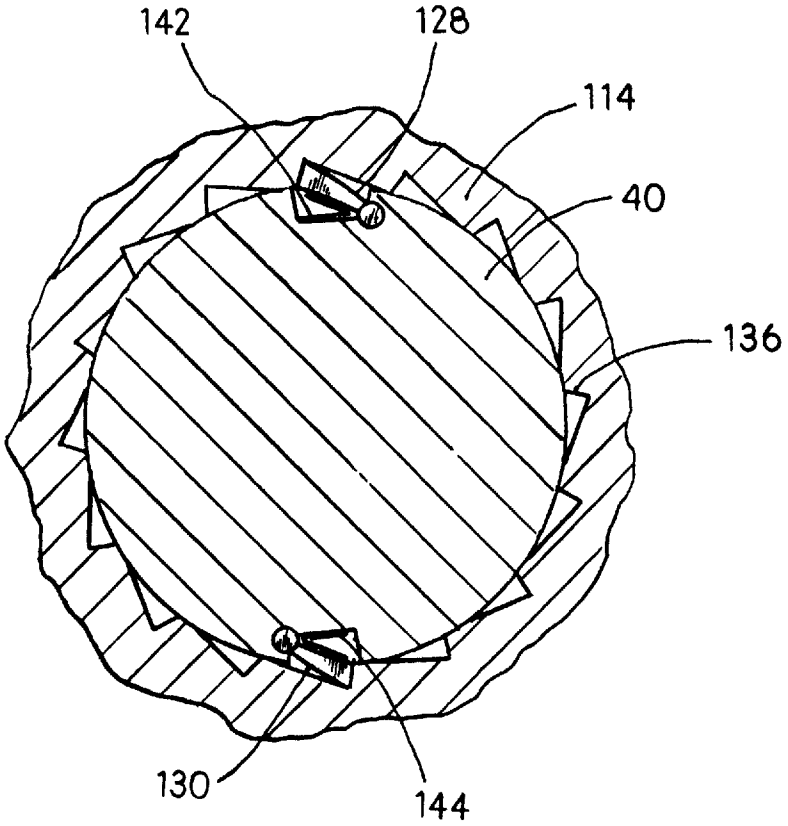
FIG. 6 is an enlarged perspective view of the engaged position of the pawls.

The clutch and ratchet mechanism 18 shown in FIGS. 5 and 6 comprises a roller 94 with a series of locking teeth 108, a pair of mounting plates 110 and 112, a shaft 40, a clutch sleeve 114, a pair of locking pin assembly 116 and 118, bearings 120, 122, 124 and 126, and a pair of pawls 128 and 130. The clutch sleeve 114 has a series of locking teeth 132 which engage with the locking teeth 108 of the roller 94. The angled teeth 134 of the clutch sleeve 114 engage with the locking pin assembly 116 and 118, and a series of ratchet teeth 136 of the clutch sleeve 114 engage with the pawls 128 and 130. A snap ring 138 is secured on the shaft 40 to locate the mounting plate 112 on the shaft 40. The two pawls 128 and 130 are attached on the shaft 40 and are hold to the position on the shaft 40 by a snap ring 140 which is secured on the shaft 40.

Further more in FIG. 6, the pawls 128 and 130 are urged in engaging relationship to a series of ratchet teeth 136 of the clutch sleeve 114 by means of two springs 142 and 144 respectively. The pawls 128 and 130 slide over the ratchet teeth 136 of the clutch sleeve 114 when the shaft 40 is rotated in a clockwise direction. The pawls 128 and 130 drive the clutch sleeve 114 to rotate in a counter clockwise direction when the shaft 40 rotate in counter clockwise direction.

Figure 9:
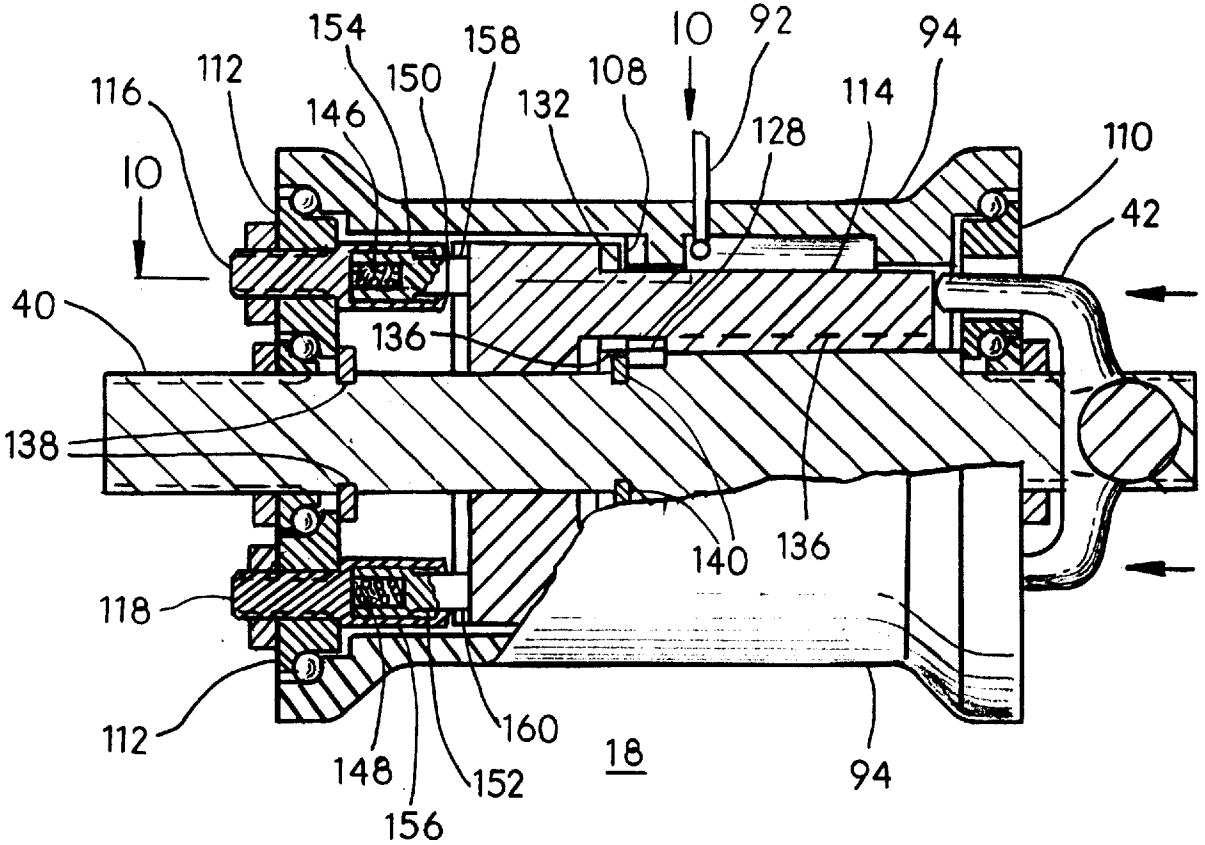
FIG. 9 is a cross sectional view taken along line 9—9 of FIG. 2 showing the clutch and ratchet mechanism in disengaged position.

As shown in FIGS. 5 and 9, the bearings 120 and 122 are mounted on the shaft 40 to pilot the mounting plates 110 and 112 respectively. The roller 94 is supported by the mounting plates 110 and 112 through the bearings 124 and 126.

Figure 7:
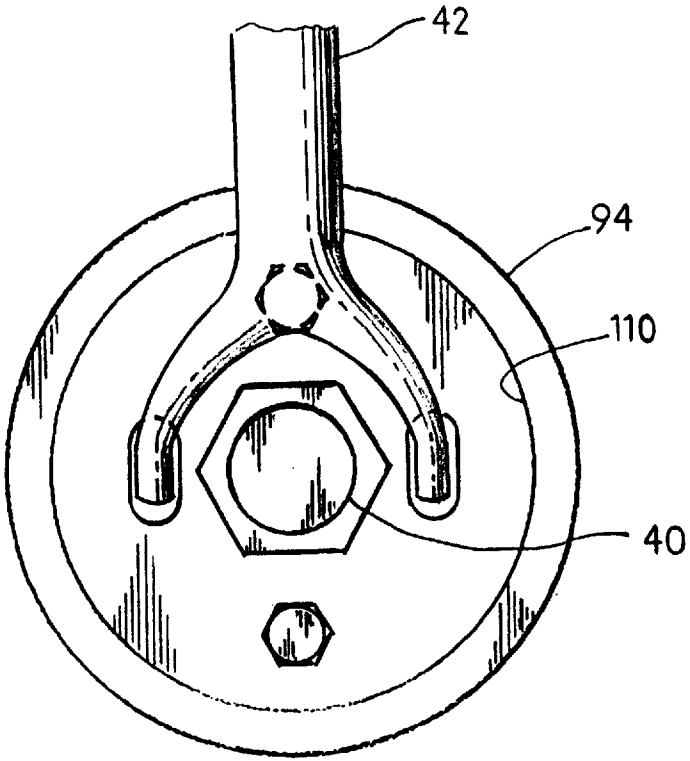
FIG. 7 is a side elevation view of the clutch and ratchet mechanism with a partial ratchet release handle.

Also FIGS. 5 and 7 show the clutch release handle 42 in the position of engaging with the clutch and ratchet mechanism 18.

As shown in FIGS. 4, 5, 8 and 9, the ratchet teeth 136 of the clutch sleeve 114 slide over the pawls 128 and 130 in axial direction along the shaft 40 when the clutch release handle 42 pushes the clutch sleeve 114, and also the locking teeth 132 of the clutch sleeve 114 disengage with the locking teeth 108 of the roller 94.

Further more in FIGS. 5, 7, 8, 9 and 10, the locking pin assembly 116 and 118 comprise respectively springs 146 and 148, locking pins 150 and 152, and threaded locking pin sleeves 154 and 156. Both locking pin assembly 116 and 118 are fastened on the mounting plate 112. The locking pin 150 and 152 allow the clutch sleeve 114 rotating only in counter clockwise direction whereby the angled ends 158 and 160 of the locking pin 150 and 152 slides over the angled teeth 134 of the clutch sleeve 114, and stop the rotation of the clutch sleeve 114 in clockwise direction by engaging the angled end 158 and 160 of the locking pin 150 and 152 with the angled teeth 134 of the clutch sleeve 114.

The clutch and ratchet mechanism 18 can be used as a device of retaining one way rotation and rapidly releasing in one way rotation for the other applications, such as fishing reels, crane machines and the other applicable devices.

Figure 8:
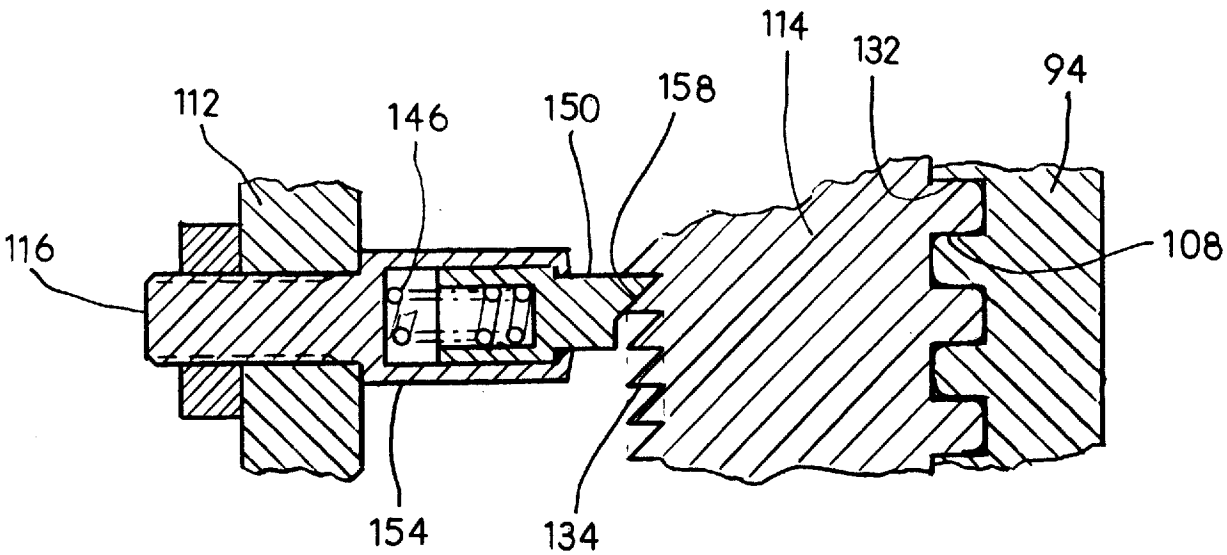
FIG. 8 is an enlarged perspective view of a partial clutch and ratchet mechanism showing the engaged position of locking pin assembly, the clutch sleeve and the roller.

The operation of the machine will now be described with reference to FIGS. 1–14. In the operation sequence, the shaft 40 will rotate in counter clockwise direction when the pedals 24 and 26 are forced to rotate in counter clockwise direction. The pawls 128 and 130 which are secured on the shaft 40 engage with the ratchet teeth 136 of the clutch sleeve 114 as shown in FIGS. 5 and 6. The roller 94 is driven by the clutch sleeve 114 with the engagement between the locking teeth 132 of the clutch sleeve 114 and the locking teeth 108 of the roller 94 as shown in FIGS. 5 and 8. The locking pins 150 and 152 will prevent the roller 94 from rotating clockwise so that the cable 92 wrapped around on the roller 94 pulls the piston 62 and the carrier 64 rearward, the short cable 82 secured on the piston 62 move rearwardly with the piston 62 and pulls the elastic bands 20 and 22 rearwardly in tension.

Figure 10:
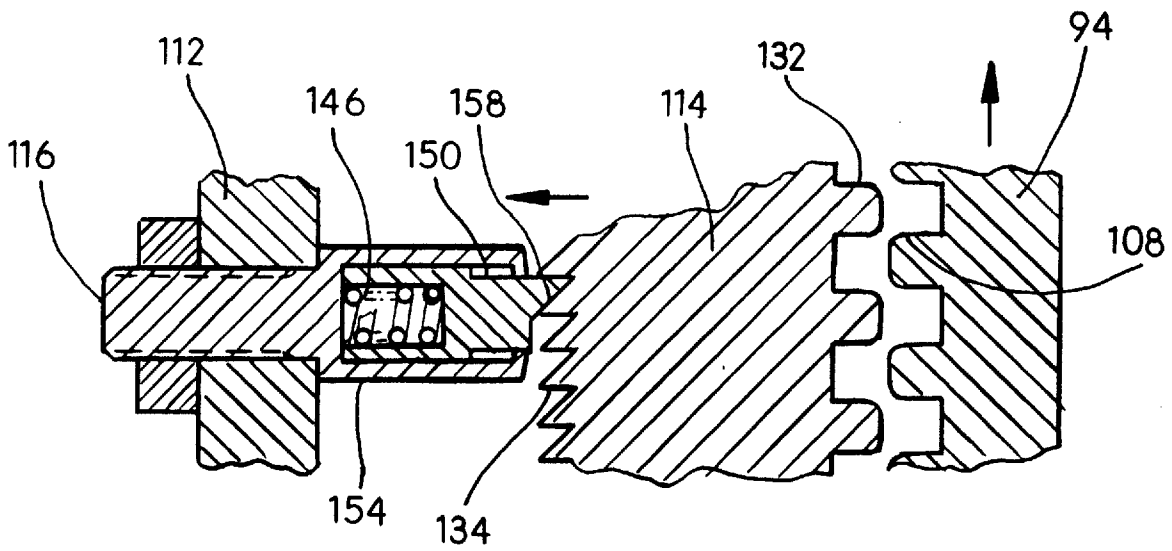
FIG.10 is an enlarged perspective view of a partial clutch and ratchet mechanism showing the disengaged position of locking pin assembly, the clutch sleeve and the roller.
Figure 11:
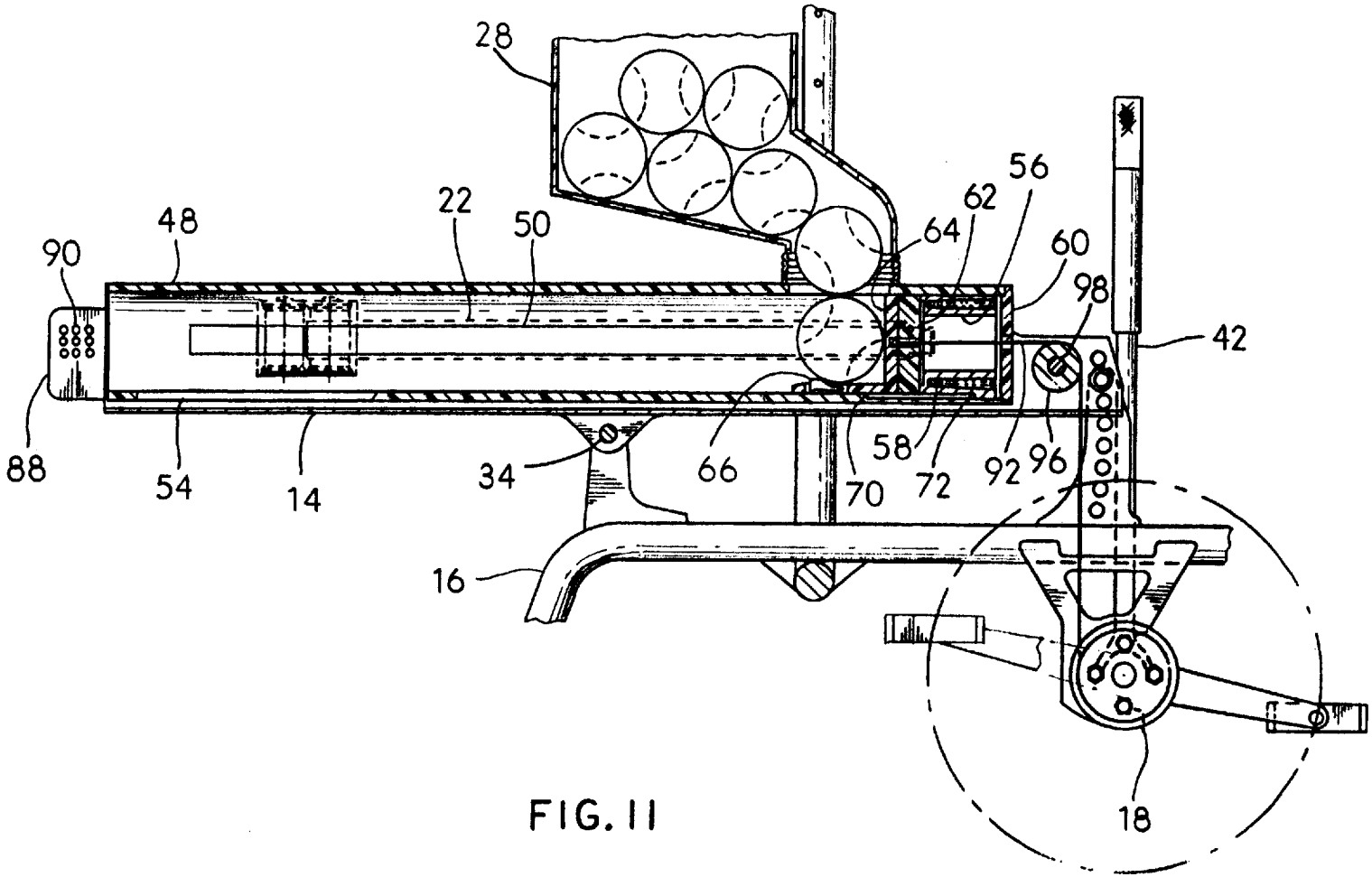
FIG. 11 is a side elevation view with a cut away along the tube assembly showing the projecting machine in loaded position.
Figure 12:
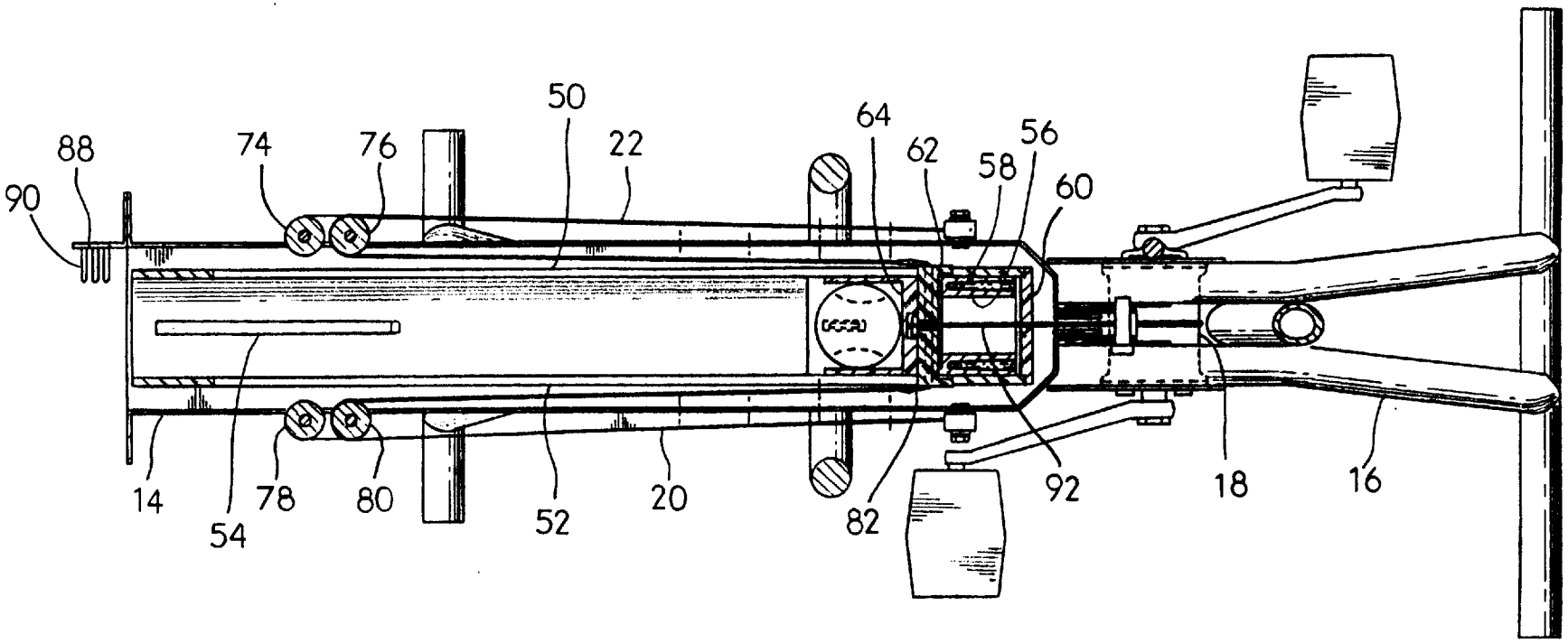
FIG. 12 is a cross sectional top view taken along line 12—12 of FIG. 2 showing the projecting machine in loaded position.

When the carrier 64 is pulled to the farthest position rearwardly at the loaded position, the ball in the basket 28 drops onto the carrier 64 while the plunger 56 is pushed rearwardly and the spring 58 is compressed. When the upper end of the clutch release handle 42, which is mounted on the support assembly 16 with a pivot point 44, is pulled outboard, the lower end of the clutch release handle 42 pushes the clutch sleeve 114 inboard. As soon as the locking teeth 132 of the clutch sleeve 114 disengage with the locking teeth 108 of the roller 94 as shown in FIGS. 9 and 10, the cable 92 will be released violently and the carrier 64 and the piston 62 are forced to move forward rapidly by the tension force of the elastic bands 20 and 22. The carrier 64 accelerates the ball forwardly.

Figure 13:
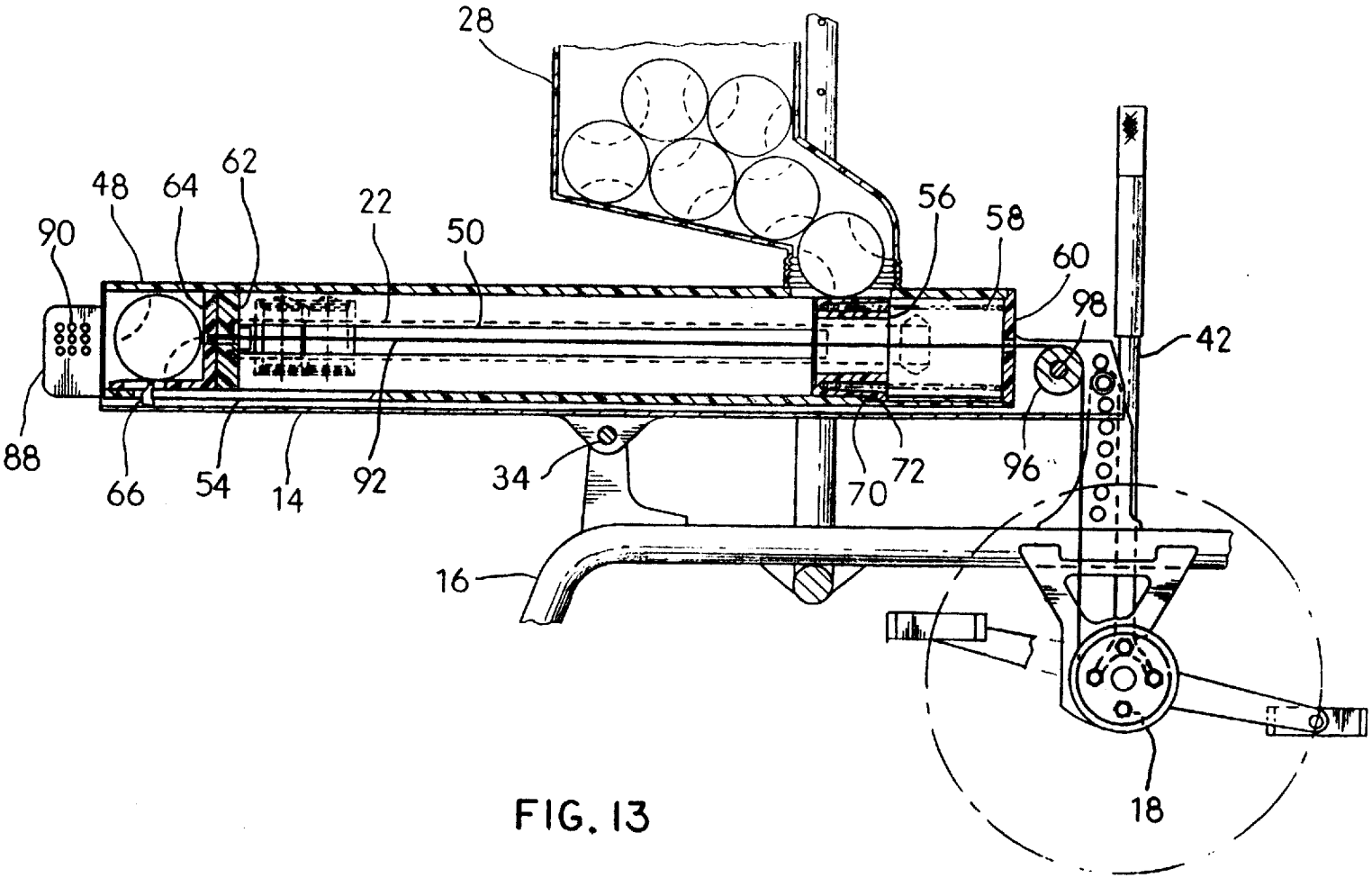
FIG. 13 is a side elevation view with a cut away along the tube assembly showing the projecting machine in release position.
Figure 14:
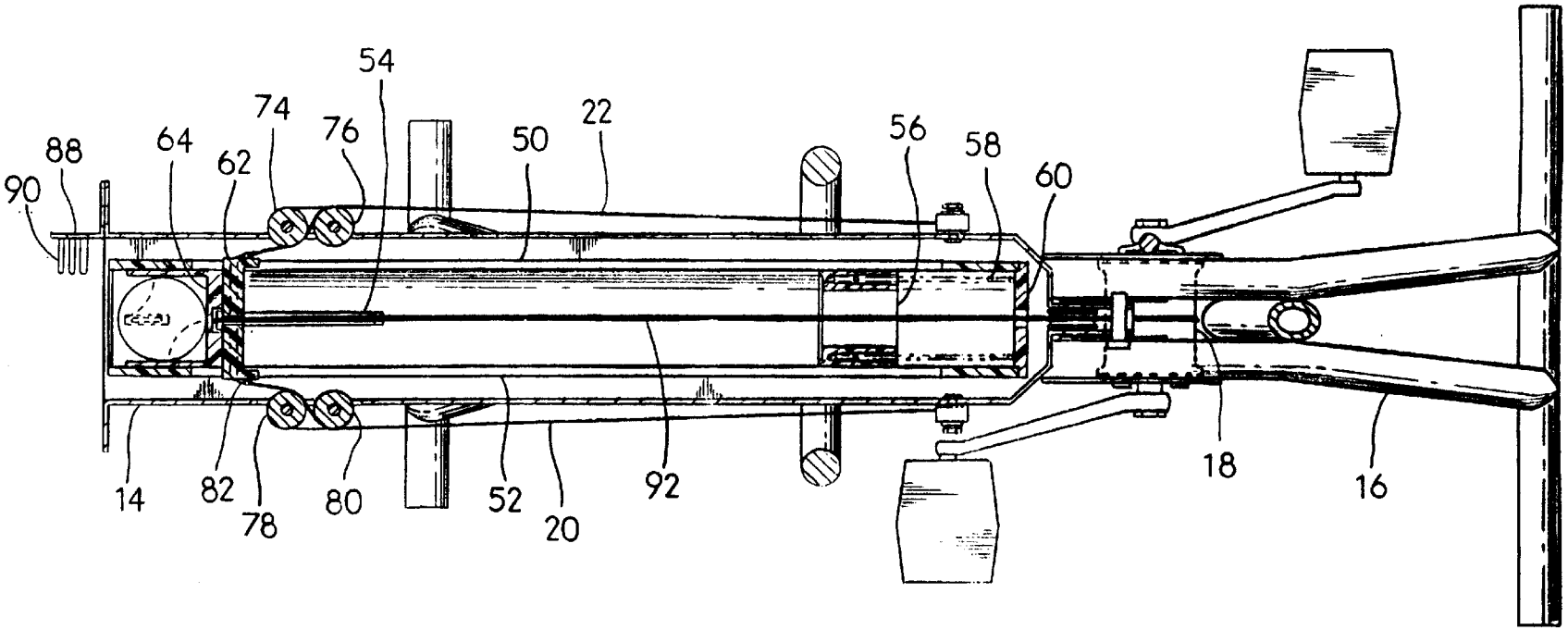
FIG. 14 is a cross sectional top view taken along line 14—14 of FIG. 2 showing the projecting machine in release position.

When the carrier 64 reaches to the slot 54 at the forward end of the tubular body 48, the retaining tab 66 rotates around the pin 68 into the slot 54, and the ball is projected out of the tubular body 48 at the release position as shown in FIGS. 13 and 14.

The tension force of the elastic bands 20 and 22 will bring the carrier 64 and the piston 62 to the neutral position which is between the roller 74 and 76, 78 and 80, as shown in FIGS. 3 and 4.

It is obvious that many modification and variations of the described invention are possible in light of these teaching, for example; bearings can be used at the rotating elements of the machine for reducing the friction and increasing the efficiency of the machine.

We claim:

1. An elastic band powered ball projecting machine, comprising:

a frame;

an elongated barrel mounted to said frame;

a carrier piston means adapted to receive a projectile movable through said barrel between a forward launch position and a rearward cocked position in which said carrier piston means includes a carrier mounted to a piston;

elastic means connected between said carrier piston and said frame to bias said carrier piston toward said forward launch position;

means to selectively draw said carrier piston toward said rearward cocked position, comprising:

a cable connected at one end to said carrier piston, and at the other end to a rotatable roller;

rotating means mounted to said frame including two pedals for operation by the feet of a user for rotating said roller for taking up said cable and drawing said carrier piston toward said rearward position;

clutch means selectively engageable and disengageable by said user for selectively engaging and disengaging said rotating means and said roller;

whereby a user may operate said rotating means by pedaling with the feet while said clutch means is engaged, thereby pulling said carrier piston toward said rearward cocked position, and then disengage said clutch means to allow said roller to rotate freely, allowing said carrier piston to move under said bias toward said forward release position, and launch a projectile received in said carrier piston.

2. The machine of claim 1 further including means to selectively vary the angle of the barrel comprising a pivot pin connecting the barrel to the frame, where the barrel is rotated about said pivot pin to align an opening in the barrel with one of a plurality of holes in the frame in which the barrel angle is selectively secured by a pin through the opening and hole.

3. The machine of claim 1 wherein the barrel includes a friction pad to impart a spin on a ball to cause the ball to have a curved flight path.

4. The machine of claim 1 further including a handle support disposed on said frame with an adjustable handle and a ball basket mounted on said handle support, wherein said frame further includes a seat for supporting the user while operating the machine.

5. The machine of claim 1, wherein said carrier has a locking tab secured on a low slot of said carrier by a pin and said locking tab falls out of said slot of said carrier at forward end of said tubular body when said carrier moves to said forward end for releasing the ball.

6. The machine of claim 1 wherein the clutch means comprises:

a shaft connecting said two pedals;

a clutch sleeve disposed between said roller and said shaft for transmitting rotation motion from said shaft to said roller includes a series of ratchet teeth for engaging said roller;

a pair of pawls secured on said shaft for engaging said shaft with said clutch sleeve in one way rotation for cocking the machine;

a pair of locking pin assemblies engaging with said clutch sleeve in one way rotation.

7. The machine of claim 6 wherein the said pair of locking pin assemblies each comprise a pin with an angled end engaging with said clutch sleeve, a locking pin support secured on one of said supporting plates, and a spring disposed between said pin and said locking pin support to urge said angled end of said pin engaging with said clutch sleeve.

8. The machine of claim 6 wherein said clutch sleeve has a series of ratchet teeth for engaging with said pin of said locking pin assembly.

9. The machine of claim 6 wherein said roller has a series teeth for engaging with said clutch sleeve.

10. The machine of claim 6 wherein said clutch sleeve has a series of ratchet teeth for engaging with said pawls.

11. The machine of claim 6 wherein said clutch sleeve has a series of teeth for engaging with said roller.

12. The machine of claim 6, wherein said clutch sleeve disengages with said roller and still engages with both said pins of said locking pin assemblies and said pawls disposed on said shaft whereby said clutch sleeve is pushed along said shaft inwardly.

* * * * *